US006105474A

United States Patent [19]

Anderson

[11] Patent Number: 6,105,474

[45] **Date of Patent: *Aug. 22, 2000**

[54] DRIVER TOOL WITH EFFICIENT HIGH ENERGY PERMANENT MAGNETIZER ON TOOL HANDLE

[76] Inventor: Wayne Anderson, 65 Grove St., Newport, N.Y. 11768

[ * ] Notice: This patent issued on a continued prosecution application filed under 37 CFR 1.53(d), and is subject to the twenty year patent term provisions of 35 U.S.C. 154(a)(2).

[21] Appl. No.: 08/690,740

[22] Filed: Jul. 31, 1996

[51] Int. Cl.[7] ..... B25B 23/08

[52] U.S. Cl. ..... 81/451; 81/125

[58] Field of Search ..... 81/451, 125

[56] References Cited

U.S. PATENT DOCUMENTS

| | | | |
|---|---|---|---|
| 2,782,822 | 2/1957 | Clark | 81/451 |
| 3,253,626 | 5/1966 | Stillwagon, Jr. et al. | 81/125 |
| 3,320,563 | 5/1967 | Clark . | |
| 3,392,767 | 7/1968 | Stillwagon, Jr. | 81/451 |
| 3,707,894 | 1/1973 | Stillwagon, Jr. | 81/451 |
| 5,178,048 | 1/1993 | Matechuk | 81/125 |
| 5,259,277 | 11/1993 | Zurbuchen | 81/900 |
| 5,577,426 | 11/1996 | Eggert et al. | 81/125 |

FOREIGN PATENT DOCUMENTS

| | | | |
|---|---|---|---|
| 869431 | 5/1961 | United Kingdom | 81/451 |

*Primary Examiner*—David A. Scherbel
*Assistant Examiner*—Joni Danganan
*Attorney, Agent, or Firm*—Lackenbach Siegel Marzullo Aronson & Greenspan, P.C.

[57] ABSTRACT

A driver bit tool having an elongate handle that has a central channel through which a predetermined length portion of the bit driver can be inserted. The driver bit is retained within the handle by any suitable means and one or more relatively thin magnets having high energy products are arranged on the side of the handle in close proximity to the driver bit receiving channel for generating a magnetic field which is substantially normal to the handle axis, the field created by the magnet being coupled to the driver bit. The position of the magnets and annular sleeves of magnetizable material are preferably used to optimize coupling of the field to the driver bit to optimize the amount of magnetic field that passes through the accessible operative tip of the driver bit so as to effectively magnetize the exposed driver tip of the bit driver.

21 Claims, 3 Drawing Sheets

FIG.13
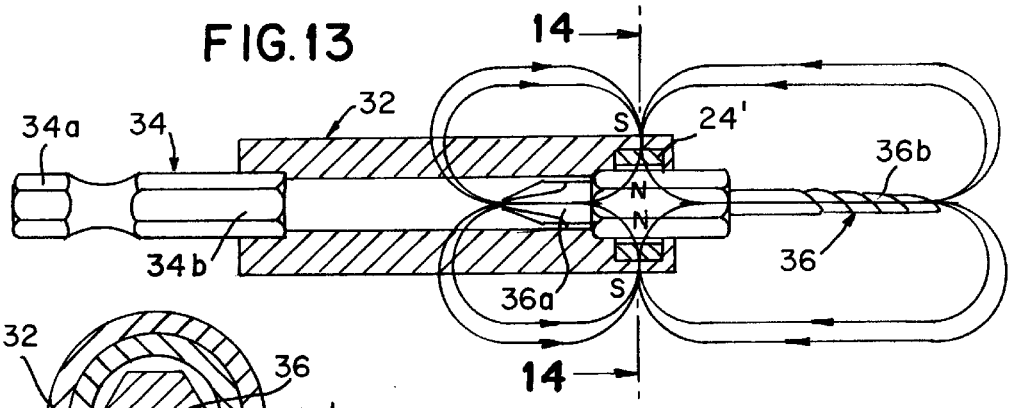
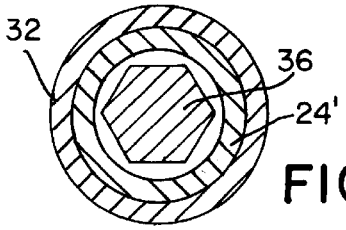
FIG.14
FIG.15
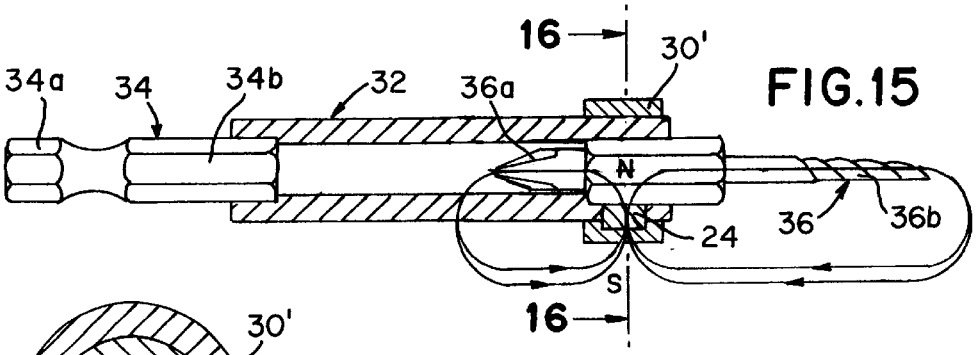
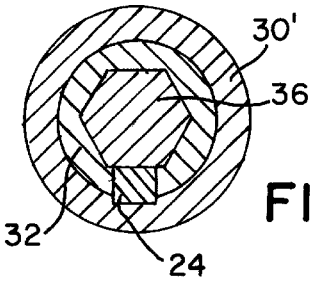
FIG.16
FIG.17
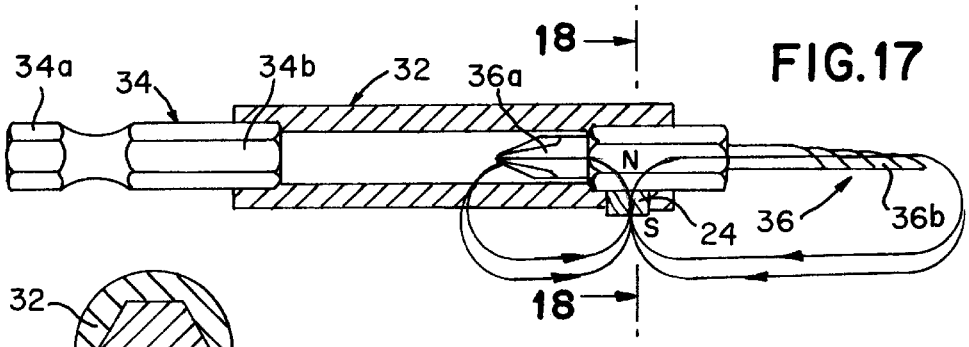
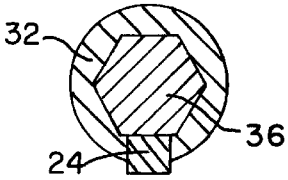
FIG.18

DRIVER TOOL WITH EFFICIENT HIGH ENERGY PERMANENT MAGNETIZER ON TOOL HANDLE

BACKGROUND OF THE INVENTION

1. Field of the Invention

The present invention generally relates to tools, and more specifically, to a driver tool having an elongate handle which embodies at least one permanent efficient high energy magnet on the tool handle for magnetizing the exposed tips of screwdriver bits or other drivers mounted on the handle.

2. Description of Prior Art

It is frequently desirable to magnetize the tips of screwdriver bits and the like to form at least temporary magnetic poles on the tips which attract magnetizable elements. Thus, particularly with precision screwdrivers which tend to be relatively small and are used to drive relatively small screws, it is frequently advantageous to magnetize the screwdriver tips of the driver bits to maintain the screwdriver tip blade within the slot of a head of a screw or a phillips driver within the cross slots formed within the head of the screw adapted to receive the phillips screwdriver tip. By magnetizing the tip of the driver bit, and mating the tip within the associated opening in the head of the screw, the screw remains attached to the bit tip without the need to hold them together. This allows the screw to be guided through a relatively small bore or channel and moved within confined spaces. Sometimes, the magnetized tip of the driver bit is used to retrieve a metal item, such as a screw, washer, nail or the like, from an inaccessible place which would otherwise be difficult to reach with anything but a relatively thin shank of a bit driver. Of course, such attachment of a fastener to the driver bit tip also frees one hand for holding or positioning the work into which the fastener is to be driven.

Devices for magnetizing/demagnetizing tools and small parts are well known. These normally incorporate one or more permanent magnets which create a sufficiently high magnetic field to magnetize at least a portion of a magnetizable element brought into its field. The body can be magnetized by bringing it into a magnetic field. While the magnetic properties of all materials make them respondent in some way to magnetic fields, most materials are diamagnetic or paramagnetic and show almost no response to magnetic fields. However, a magnetizable element made of a ferromagnetic material readily responds to a magnetic field and becomes, at least temporarily, magnetized when placed in such a magnetic field.

Magnetic materials are classified as soft or hard according to the ease of magnetization. Soft materials are used as devices in which change in the magnetization during operation is desirable, sometimes rapidly, as in AC generators and transformers. Most bit drivers are made magnetically soft materials which are not normally magnetized. In order for such bit drivers to exhibit magnetic poles they must be placed in a magnetic filed. Hard materials are used to supply fixed fields either to act alone, as in a magnetic separator, or interact with others, as in loud speakers and instruments.

Most magnetizers/demagnetizers include commercial magnets which are formed of either Alnico or are of the ceramic type. The driver members, on the other hand, are normally made of soft materials which are readily magnetized but more easily lose their magnetization, such as by being drawn over an iron or steel surface, subjected to a demagnetizing influence, such as heavy magnetic fields or other permanent magnetic fields, severe mechanical shock or extreme temperature variations.

One example of a magnetizer/demagnetizer is magnetizer/demagnetizer Model No. 40010, made in Germany by Wiha. This unit is in the form of a box made from plastic and forms two spaced openings defined by three spaced transverse portions. Magnets are placed within one of the transverse portions to provide magnetic fields, in each of the two openings which are directed in substantially opposing directions. Therefore, when a magnetizable tool bit or any magnetizable component is placed within one of the openings, it becomes magnetized and when placed in the other of the openings, it becomes demagnetized. The demagnetizing window is provided progressive steps to decrease the air gap for the demagnetizing field and, therefore, provides different levels of strengths of the demagnetizing field. However, typical magnetic materials that are used with conventional magnetizers/demagnetizers include Alnico and ceramic magnets which typically have energy products equal to approximately $4.5\times10^6$ gauss-oersteds and $2.2\times10^6$ gauss-oersteds, respectively.

Since the field strength B at the pole of the magnet is a product of the unit field strength and the area, and since the force of the magnet (H) is the product of the unit force (are the same unit field strengths) and the length of the magnet, it follows that the energy content or BH product, is proportional to the volume of the magnet. It is for this reason that conventional magnetizers/demagnetizers have required bulky magnets having significant volumes to provide the desired energy content suitable for magnetizing and demagnetizing parts. However, the required volumes have rendered it impossible or impractical to incorporate the magnetizers/demagnetizers on the tools in conjunction with which they are frequently used. Thus, for example, precision screwdrivers, which are relatively small and have relatively small diameter handles could not possibly incorporate sufficient magnetic material to provide desired or required levels of magnetic fields for magnetizing and demagnetizing parts. However, the requirement of using separate magnetizers/demagnetizers units, has rendered their use less practical. Thus, unless a user of a precision screwdriver or any driver tool obtained a separate magnetizer/demagnetizer one would not normally be available for use. Additionally, even if such magnetizer/demagnetizer were available, it would require a separate component which could be misplaced and not available when needed. Of course, there is always the risk that the magnetizer/demagnetizer could become misplaced or lost, rendering the use of the driver tool less useful.

A well known design of a magnetizable driver tool 10 is illustrated in FIG. 1, in which the handle 12 is provided with central axial channel 14 which receives a portion 16*a* of a driver bit, leaving an external portion 16*b* exposed which has, at its free end, an operating tip 16*c* for driving, for example, a fastener. Another operative tip 16*d* is typically provided at the other end of the bit driver 16 which may be the same as or different than the operative tip 16*c*. In FIG. 1, the operative tip 16*c* is a screwdriver tip while the operative tip 16*d* is a Phillips driver. A chuck 18 may be used to selectively remove the bit driver 16 and reverse its direction to allow use of either one of the two operative tips or to replace the driver with another driver bit. In an effort to magnetize the bit driver 16, and more specifically provide a pole at the operative tip 16*c* which can attract a magnetizable fastener, there has typically been provided an in-line permanent magnet 20 arranged along the axis A of the tool with poles at 20*a* and 20*b* as shown. Such a magnet 20 gives rise to a magnetic field of the type illustrated and designated by the reference numeral 22. However, as will be seen, such field 22 only partially interacts with the bit driver 16, and primarily that portion of the driver 16*d* closest to the magnet 20. Such magnetic field does not create a very strong magnetic pole at the operative tip 16*c*. In order to increase the strength of the pole, the size of the magnet 20 has been increased in order to enhance the magnetic field 22. However, this rendered the magnet 20 relatively large in relation to the size of the handle 12 and significantly increased the weight of the tool. Even so, the degree of magnetic field coupling to the bit driver 16, particularly the exposed operative tip 16*c*, has remained low and, thus, the strength of the magnetic pole created at that end has remained relatively small.

SUMMARY OF THE INVENTION

Accordingly, it is an object of the present invention to provide a driver tool which magnetizes a tool driver made of soft magnetic material which does not have the disadvantages inherent in such prior art tools.

It is another object of the present invention to provide a driver tool with an efficient high energy, permanent magnetizer on the tool handle which is simple in construction and economical to manufacture.

It is still another object of the present invention to provide a driver tool of the type suggested which provides a strong and effective pole at the exposed end of the bit driver by providing enhanced coupling between the permanent magnet and the bit driver.

It is yet another object of the present invention to provide a driver tool as in the previous objects which is light weight and less bulky than such prior art tools.

It is a further object of the present invention to provide a driver tool which can variably provide a magnetic pole at the exposed driver tip which can be made stronger or weaker depending on the application.

It is still a further object of the present invention to provide a driver tool as described in the previous objects which does not require bulky magnets and, therefore, the tool handle can be used for storage of additional bits instead of having a significant portion of the handle occupied by a permanent magnet.

In order to achieve the above objects, as well as others which will become apparent hereafter, a tool in accordance with the present invention, for use with an elongate bit driver made of a magnetizable metallic material, comprises an elongate handle defining a handle axis. Said handle has an essentially elongate channel extending along said handle axis and being open at at least one axial end for longitudinally receiving only a predetermined length portion of the bit driver at one end of the bit driver and the other end of the bit driver being exposed and defining a driver tip. Retaining means is provided for retaining the bit driver fixed to said handle during normal use of the tool, said handle defining a receiving zone extending from said open end and having an axial length at least equal to said predetermined length for receiving said predetermined length portion of the bit driver. Magnet means is provided along said receiving zone of said handle in close proximity to said channel for generating a magnetic field defining a magnetic axis which is substantially normal to said handle axis. In this manner, the bit driver becomes part of the magnetic circuit of said magnet means and at least some of the magnetic field passes to the bit driver through at least partially shunt the magnetic field and magnetize the exposed driver tip of the bit driver.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of preferred embodiments in which:

FIG. 13 illustrates the use of the present invention on a bit receiving holder other than a conventional handle, in which the permanent magnet is in the form of an annulus similar to the embodiment shown in FIGS. 7 and 8 which surrounds the bit driver in its normal operating position;

FIG. 14 is a cross-sectional of the device shown in FIG. 13, taken along line 14—14;

FIG. 15 is similar to FIG. 13, except that a disk or pill magnet is used in combination with a magnetizable sleeve which is placed on the magnetic circuit of the permanent magnet;

FIG. 16 is a cross-sectional view of the device shown in FIG. 15, taken along line 16—16;

FIG. 17 is similar to FIG. 15, except that no annular sleeve is used; and FIG. 18 is a cross-sectional view of the device shown in FIG. 17, taken along 18—18.

DESCRIPTION OF THE PREFERRED EMBODIMENT

Figure 1:
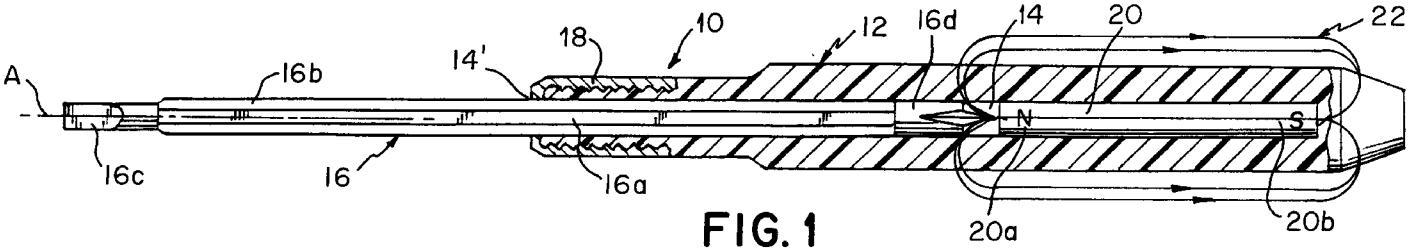
FIG. 1 PRIOR ART
FIG. 1 is a side elevational view, partially in longitudinal cross-section, of a driver tool with a permanent magnet on the tool handle to magnetize the driver tip in accordance with the prior art.
Figure 2:
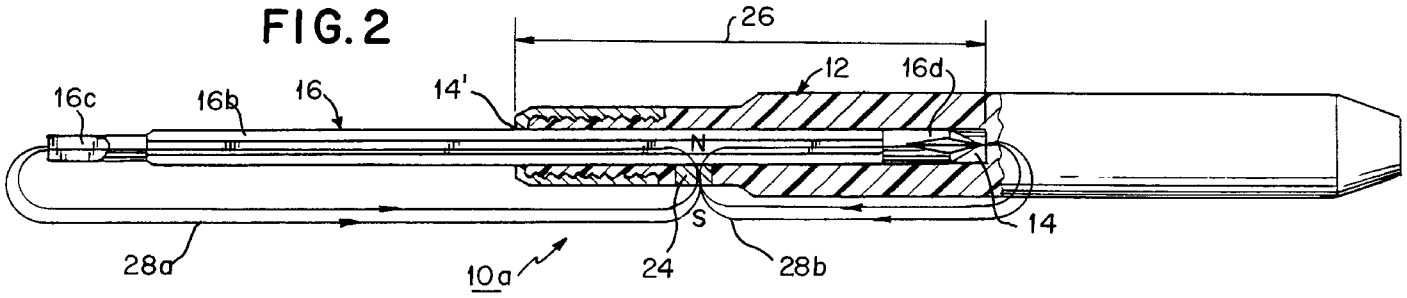
FIG. 2 is similar to FIG. 1, but showing one embodiment of the present invention in which a high energy permanent magnet is efficiently located on the tool handle on the side of the driver bit within the receiving zone for receiving a portion of the bit driver.
Figure 3:
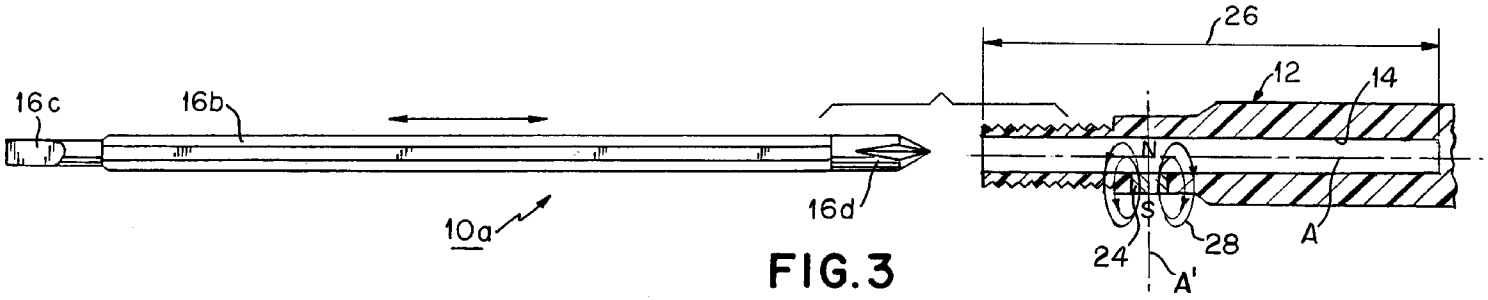
FIG. 3 is an exploded view of the embodiment shown in FIG. 2, illustrating the bit driver removed from the channel defining the bit driver receiving zone and the action of the permanent magnet creating a magnetic field within the channel.

Referring now specifically to the figures, in which identical or similar parts are designated by the same reference numerals throughout, and first referring to FIGS. 2 and 3, a driver tool 10*a* is illustrated which is generally similar to the prior art tool 10 illustrated in FIG. 1. However, the tool 10*a* does not require a bulky magnet of the type illustrated by the reference numeral 20 in FIG. 1 and which occupies a substantial portion of the volume of the tool handle. Instead, the present invention contemplates the use of one or more relatively small, high energy product permanent magnets embedded on the side of a handle 12 in a region proximate to the bit 16 when same is inserted into the handle during normal use as illustrated in FIG. 2. More specifically, the elongate channel 14 is adapted to longitudinally receive a predetermined length portion of the bit driver, the handle defining a receiving zone 26 which extends from the open end 14' of the channel 14 and has an axial length at least equal to the predetermined length of the bit driver to be received within the handle. As illustrated in FIG. 3, the magnet 24 is arranged along the receiving zone 26 in close proximity to the channel 14 for generating a magnetic field 28 defining a magnetic axis A' which is substantially normal to the handle axis A.

The magnetic field 28 extends into the channel 14, so that when the driver bit 16 is fully inserted into the channel 14, the bit driver becomes part of the magnetic circuit of the magnet 24 to at least partially shunt the air space for the magnetic field.

Figure 4:
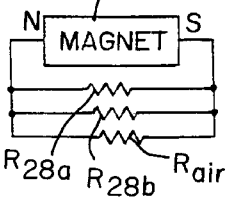
FIG. 4 is a schematic diagram illustrating the equivalent magnetic circuit for the embodiment illustrated in FIG. 2.

Referring to FIG. 4, the magnet 24 generates a magnetic field 28 in the configuration illustrated in FIG. 3, prior to insertion of the driver bit. This configuration, with air initially occupying the space within the channel 14 presents a generally high reluctance to the magnetic field, this being represented by $R_{air}$. However, as illustrated in FIG. 2, once the driver bit 16 is inserted into the channel 14, the magnetic fields 28*a,* 28*b* now has alternate, parallel paths within which to pass, namely the magnetic material of which the driver bit is made. A modified magnetic filed (not shown) continues to exist representing modified $R_{air}$. In FIG. 4, the reluctances represented by the driver bit portion is designated $R_{28a}$, $R_{28b}$. It is clear from the circuit in FIG. 4, that if reluctance of the bit portion is substantially less than the reluctance of the air, which it always is, a considerable part of the flux will pass through the driver bit and significantly bypass the air path. As best illustrated in FIG. 2, the magnetic field will redistribute itself and some of that field will pass through the operative tip 16*c* to thereby magnetize the same. As will also be evidenced from FIG. 4, the greater the strength of the magnet 24 and the less the value of the bit reluctances, the greater will be the amount of field that passes through the driver bit and the stronger the pole formed at the exposed operative tip 16*c*. Therefore, aside from increasing the energy product of the magnet 24, the desired effect can be enhanced by movement of the magnet 24 forward as much as possible in the direction of the opening 14' of the channel 14 or the front end of the tool handle. The reason for this is that the reluctance of the bit is really a function of the two parallel paths 28*a,* 28*b* within the driver bit itself, the first reluctance $R_{28a}$ being represented by that portion of the bit positioned to one side of the magnet 24 and the other reluctance $R_{28b}$ being represented by that portion of the bit to the other side of the magnet. The further that the magnet is moved towards the front of the tool, the greater will be the useful coupling of the field through the front portion of the bit where the pole is desirably formed. The positioning of the permanent magnet 24, in accordance with the invention, therefore, is such so as to place the magnet in a way that the driver bit effectively couples to the magnetic filed and becomes an active element in the magnetic circuit of the magnet 24 to substantially shunt the field to ensure that at least some but preferably a substantial amount of flux is passed through the exposed operative tip 16*c*.

As indicated, one of the important factors in determining the strength of the pole formed at the exposed operative tip 16*c* is the strength of the magnet 24 itself. As will be appreciated from FIGS. 2 and 3, however, the amount of space available for the magnet in the wall on the side of the handle 12 proximate to the channel 14 is quite small. The magnet 24 must, therefore, be in the form of a relatively thin magnet. However, in order to produce the levels of magnetization desired and in order to form effective poles on the driver tips, one of the features of the present invention is the use of magnets having high magnetic energy products.

Numerous arrangements of magnets may be used to provide enhanced magnetizing fields on conventional handles of driver tools. While this is made possible by the use of permanent magnets which have energy products BH equal to at least $7.0\times10^6$ gauss-oersteds, it is preferred that the magnetic materials used be formed of magnetic materials which have energy products equal to at least approximately $9\times10^6$ gauss-oersteds. Such levels of energy products are obtainable with the classes of materials generally known as neodymium iron boron and cobalt rare earth permanent magnets. Such materials are available, for example, from Polymag, Inc. of Bellport, N.Y. and sold under style designations PM70, Poly 10, NDFB30H, NDFB35, NDFB27; and from Hitachi Magnetics Corporation, Division of Hitachi Metals International, Ltd. under the style designations Hicorex 90A, 90B, 96A, 96B, 99A and 99B.

Although the magnet 24 in the first embodiment shown in FIGS. 2 and 3 is in the form of a thin pill or disk magnet consistent with the thickness of the wall forming the handle proximate to the channel 14, other arrangements are possible and contemplated by the present invention. For Example, in FIGS. 5 and 6, an alternate embodiment 10*b* is illustrated in which the magnet 24 of the first embodiment is augmented by an annular sleeve 30 formed of magnetizable material but not being a permanent magnet itself. The magnet 24 is shown to be in contact, at its outer pole face, with the sleeve 30 so as to eliminate any air gap and, therefore, minimize the reluctance and enhance the amount of coupling of the field through the sleeve. Since the sleeve extends axially forwardly in the direction of the exposed part 16*b* of the driver bit, this will have the effect of still further reducing the reluctance $R_{28a}$ associated for that portion of the bit driver to the left of the magnet, as viewed in FIG. 5. This will, for reasons indicated, increase the amount of flux which passes through the operative tip 16*c* and, therefore, this will strengthen the pole at that tip.

Figure 5:
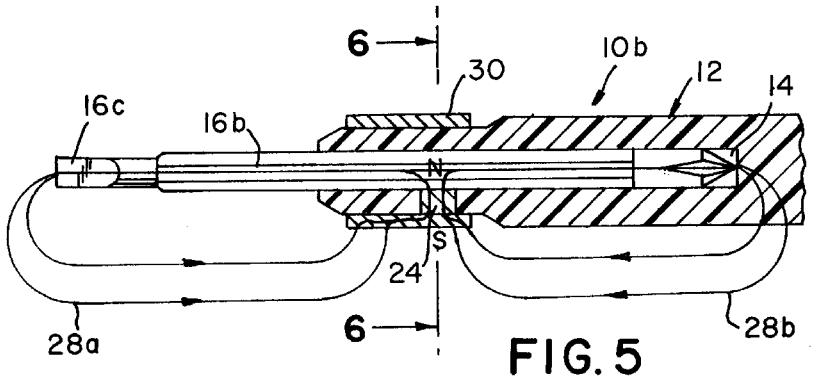
FIG. 5 is similar to FIG. 2 but showing another embodiment in which there is further provided a magnetizable sleeve surrounding the permanent magnet.
Figure 6:
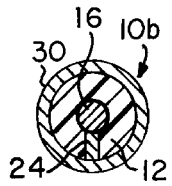
FIG. 6 is a cross-sectional view of the tool shown in FIG. 5, taken along lines 6—6.
Figure 7:
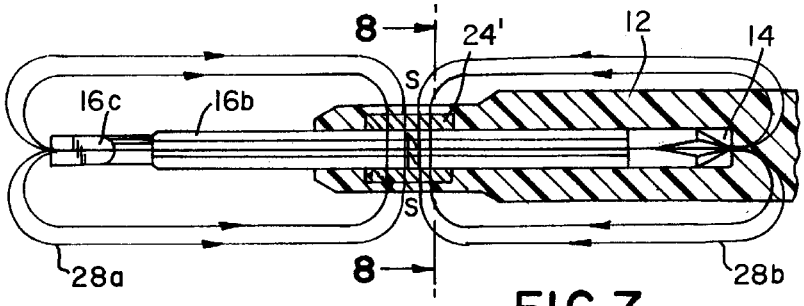
FIG. 7 is a view similar to that shown in FIG. 5, but illustrating a further embodiment in which the permanent magnet is in the form of an annular sleeve embedded within the handle as shown so as to encircle the bit driver during normal use.
Figure 8:
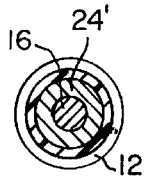
FIG. 8 is a cross-sectional of the tool shown in FIG. 7, taken along lines 8—8.

In FIGS. 7 and 8, much of the benefit of the sleeve 30 of FIGS. 5 and 6 is obtained by using a modified magnet 24' in the form of an annular sleeve having a relatively thin wall, as shown, so that it can be embedded within the tool handle. This magnetic sleeve 24*a,* although it may render it more difficult to assemble the tool, normally provides a greater volume of permanent magnetic material, thereby increasing the strength of the field and the amount of the field coupled to the exposed operative tip 16*c*.

Figure 9:
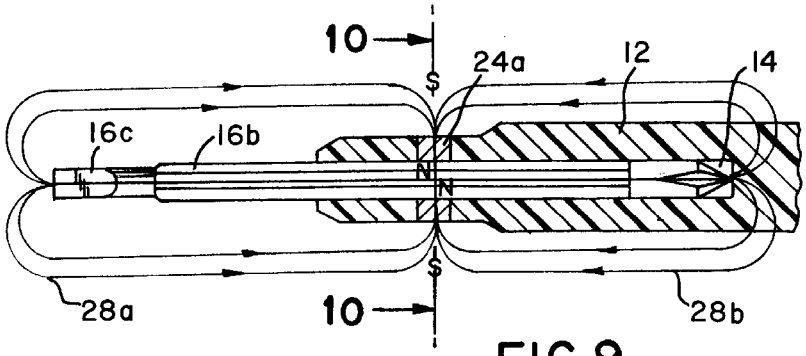
FIG. 9 is a view similar to that shown in FIG. 2, but illustrating another embodiment in which two permanent magnets are provided on diametrically opposite sides of the bit driver receiving channel.
Figure 10:
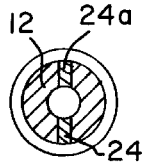
FIG. 10 is a cross-sectional view of the tool shown in FIG. 9, taken along lines 10—10.

In FIGS. 9 and 10, two disks or pill magnets 24, 24*a* of the type shown in FIGS. 2 and 3 are used to double the strength of the magnetic field, the two magnets being positioned on diametrically opposite sides of the channel 14 to ensure that the fields produced by each of the magnets similarly couples to the driver bit.

Figure 11:
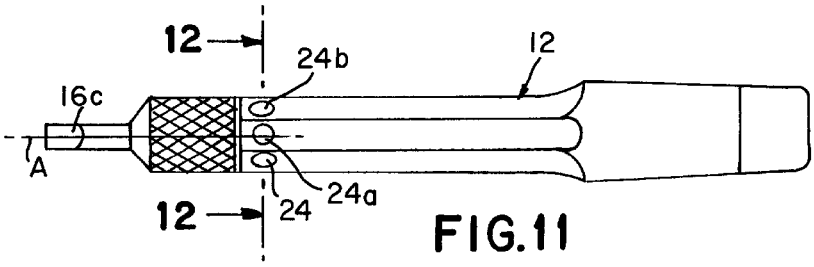
FIG. 11 is a side elevational view of yet a further embodiment of the present invention in which a plurality of permanent magnets are embedded within the tool handle about the bit receiving channel, the number of such magnets used in this embodiment being six.
Figure 12:
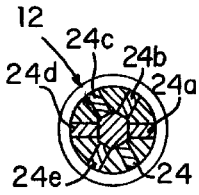
FIG. 12 is a cross-sectional view of the tool shown in FIG. 11, taken along line 12—12.

In FIGS. 11 and 12, the arrangement of FIGS. 9 and 10 is extended by providing six permanent magnets 24, 24*a*, 24*b*, 24*c*, 24*d*, 24*e* substantially equally angularly spaced from each other about the tool axis A and on opposite sides of the driver bit or receiving channel 14. In theory, assuming that all of the pill or disk magnets are the same size, the strength of the pole formed at the operative driver tip 16*c* with the embodiment shown in FIGS. 11 and 12 should be approximately six times that of the arrangements shown in FIGS. 2 and 3 and three times the strength of the arrangement shown in FIGS. 9 and 10, barring saturation problems.

Another annular magnet arrangement is illustrated in FIGS. 13 and 14, in which two driver bits 34, 36 are illustrated mounted on opposite axial ends of a bit carrying tube 32, one of the axial ends having embedded therein a sleeve magnet of the type shown in FIGS. 7 and 8. Each of the driver bits is shown to include two separate driver tips or ends 34*a*, 34*b* and 36*a*, 36*b*, respectively, useful for driving various fasteners, and, in the case of the end 36*b* also to drill a hole. If the tube 32 is made sufficiently large it can, of course, also serve as a tool handle. However, the arrangement shown in FIGS. 13 and 14 represents a tubular driver bit member usable in connection with multi-bit tools, such as the eight-in-one driver tool disclosed in U.S. patent application Ser. No. 08/620,471, assigned to same assignee as the present application. Similar multiple bit supporting tubes are also illustrated in FIGS. 15–18 in which some of the other arrangements of the permanent magnets previously described can also be used. Thus, in FIGS. 15 and 16, an annular sleeve 30' is illustrated which is in contact at one polar face with the pill or disk magnet 24 but which itself is not a permanent magnet but formed of a magnetizable material. Therefore, the embodiment illustrated in FIGS. 15 and 16 generally correspond to that illustrated in FIGS. 5 and 6. Similarly, the use of a single magnet can also be used in connection with a tubular support member of the type shown as indicated in FIGS. 17 and 18, which corresponds to the tool embodiment shown in FIGS. 2 and 3. Therefore, it will be clear, that the magnets and their arrangements in accordance with the present invention can either be on a handle of the driver tool, if the bit drivers are received directly within the handle or on a tube support structure 32, if such tubes are inserted within a handle, as with the eight-in-one tool. Whichever structure is used, it is important that one or more magnets be placed as close as possible to the driver bit and to the accessible operative tip, with minimum air gaps and with permanent magnets which are sufficiently strong to provide the desired result.

While this invention has been described in detail with particular reference to a preferred embodiment thereof, it will be understood that variations and modification will be effected within the spirit and scope of the invention as described herein and as defined in the appended claims.

I claim:

1. A hand tool for use with an elongate driver bit means made of a magnetizable material for providing a driver bit at at least one end thereof, the tool comprising an elongate handle defining a handle axis and configured to be gripped by a user's hand for applying a torque thereto about said axis, said handle having a central elongate channel extending along said handle axis and open at at least one axial end for longitudinally receiving only a predetermined length portion of said driver bit means, a portion of the driver bit means being exposed and extending distally from said elongate handle and having a driver tip; retaining means on said handle for retaining the driver bit means fixed to said handle during normal use of the tool for transmitting torque applied to said handle to said driver bit means, said handle defining a receiving zone within said elongate channel extending from said open end and having an axial length for receiving said predetermined length portion of said driver bit means; and magnet means mounted along said receiving zone of said handle along said predetermibed length portion of said driver bit means between said opening in said elongate channel and a free end of said driver bit means received within said elongate channel for generating a magnetic field defining a magnetic axis which is substantially normal to said handle axis, whereby said driver bit means received within said elongate channel becomes part of a magnetic circuit of said magnet means and at least some of the magnetic field passes through both the received and exposed portions of said driver bit means to enhance the magnetization of the exposed tip of the driver bit.

2. A tool as defined in claim 1, wherein said magnetic means is formed of a permanently magnetized material having an energy product equal to at least $7.0\times10^6$ gauss-oersteds.

3. A tool as defined in claim 1, wherein said means is embedded within said magnet handle.

4. A tool as defined in claim 3, wherein said magnetic means are pill magnets.

5. A tool as defined in claim 1, wherein said magnet means is formed of neodymium iron boron permanent magnetic material.

6. A tool as defined in claim 1, wherein said magnet means is formed of cobalt rare earth permanent magnetic material.

7. A tool as defined in claim 1, wherein the energy product of the magnetized material is equal to at least approximately $9\times10^6$ gauss-oersteds.

8. A tool as defined in claim 1, wherein said retaining means comprises means for selectively retaining said driver bit means on said handle.

9. A tool as defined in claim 1, wherein said magnet means comprises two permanent magnets arranged on said handle on diametrically opposite sides of said channel.

10. A tool as defined in claim 9, wherein said magnets are arranged to position like magnetic polar surfaces of said two magnets facing each other across said channel.

11. A tool as defined in claim 1, wherein said driver bit means comprises a shaft, and said magnet means comprises at least one permanent magnet arranged on said handle with one of the polar surfaces generally facing radially inwardly in the direction of said shaft and the other of the polar surfaces generally facing radially outwardly in the direction away from said shaft.

12. A tool as defined in claim 11, further comprising a sleeve of magnetizable material surrounding at least an axial length portion of said handle on which said magnet means is provided, said sleeve being proximate to said other polar surface of said magnet means.

13. A tool as defined in claim 12, wherein said shaft comprises a solid rod, and said sleeve is in contact with said other polar surface to eliminate any air gap between said sleeve and said other polar surface of said magnet means.

14. A tool as defined in claim 1, wherein said magnet means comprises a plurality of permanent magnets substantially uniformly spaced from each other about said handle axis, all said permanent magnets being arranged to position like magnetic polar surfaces in a common radial direction in relation to said tool axis.

15. A tool as defined in claim 1, wherein said magnet means comprises a permanent magnet in the form of an annular ring.

16. A tool as defined in claim 15, wherein said annular ring is embedded within said handle.

17. A tool as defined in claim 1, wherein said magnet means is arranged substantially at the center of said receiving zone.

18. A tool as defined in claim 1, wherein said magnet means is arranged on said handle proximate to said opening at said at least one axial end.

19. A tool as defined in claim 1, wherein said magnet means is mounted on said handle at a point remote from said driver tip.

20. A tool as defined in claim 1, wherein said magnet means is mounted on said handle proximate to said receiving zone, whereby said magnet means is mounted proximate to said predetermined length portion of said driver bit means and axially spaced from the exposed portion of the driver bit so as not to interfere with the use of the exposed portion in confined spaces.

21. A tool as defined in claim 1, wherein said magnet means is made of a non-flexible material.

* * * * *